US005979601A

United States Patent [19]

Lu

[11] Patent Number: 5,979,601

[45] Date of Patent: Nov. 9, 1999

[54] TELESCOPIC EMERGENCY EGRESS DEVICE

[76] Inventor: Sheng-Nan Lu, No. 174, Chunying St., Shulin Chen, Taipei Hsien, Taiwan

[21] Appl. No.: 09/115,106

[22] Filed: Jul. 13, 1998

[51] Int. Cl.[6] ..... A62B 1/12

[52] U.S. Cl. ..... 182/82; 182/231; 182/236

[58] Field of Search ..... 182/82, 73, 70, 182/231, 236, 3, 42, 6, 7, 141, 37

[56] References Cited

U.S. PATENT DOCUMENTS

| | | | |
|---|---|---|---|
| 3,844,377 | 10/1974 | Wilkins | 187/37 |
| 4,287,963 | 9/1981 | Coxsey | 182/231 |
| 4,440,261 | 4/1984 | Clark | 182/82 |
| 4,703,831 | 11/1987 | Forrest | 182/42 |

FOREIGN PATENT DOCUMENTS

| | | | |
|---|---|---|---|
| 2545363 | 11/1984 | France | 182/231 |
| 594559 | 1/1979 | Switzerland | 182/36 |
| 11455 | of 1893 | United Kingdom | 182/3 |

*Primary Examiner*—Alvin Chin-Shue
*Attorney, Agent, or Firm*—Dellett and Walters

[57] ABSTRACT

A telescopic emergency egress device includes an outer tube having a front end and a back end, an inner tube having a front end and being telescopically movable along the outer tube, a spring compressed to push the inner tube to move from a retracted position to an extended position, a retainer operable to maintain the inner tube in the retracted position, and a device for lowering a person at the front end of the inner tube from a higher level to a lower level at a speed of sufficient safety to the person.

10 Claims, 4 Drawing Sheets

TELESCOPIC EMERGENCY EGRESS DEVICE

FIELD OF THE INVENTION

The present invention relates to an emergency egress device and, more particularly, to an emergency egress device of a telescopic type which can be operated easily and quickly to lower a person from a high building to the ground in case of emergency.

BACKGROUND OF THE INVENTION

More and more high buildings now exist in the world. A problem arising from them is that their excessive height may cause the occupants to be at risk when normal routes of egress are blocked or inoperative during an emergency, such as an earthquake or a fire.

In view of the problem, an egress device that can lower a user from a high level to the ground outside a building was developed. FIG. 4 shows a conventional emergency egress device in which a post (90) is pivotally connected to an arm (92) that has a ring (920) attached to the free end thereof, and a governor (94) with harness (96), line (980) and reel (98) are stored in a box (99) in the general proximity of the base of the past (90).

In the event of an emergence, the arm (92) is pivoted about an axial 900 to a horizontal position to extend the free end thereof outside a window or over the edge of a balcony and clear of the side of the building. The governor (94) with harness (96), line (980) and reel (98) are removed from the storage box (99), and the governor (94) is attached to the ring (920) at the end of the arm (92) by means of a C-ring (940). The harness (96) is attached to the rope (980) which is reeved through the governor (94) and wound on the reel (98). The reel (98) is dropped to the ground thereby unwinding the rope (980) from the reel (98). The user securely places the around his/her body, slides or jumps from the window or balcony ledge and is lowered to the ground away from the event causing the emergency.

This conventional emergency egress device is useful in an emergence, however, the primary disadvantage is the multiplicity of steps that must be taken to prepare the device for use. In short the user loses a great deal of time preparing the device before an escape can be made. Another disadvantage includes the necessity to slide or leap from the window or balcony ledge before any weight is put on the device and the user natural reluctance to take such a leap. Finally, the conventional device requires floor space for storage.

SUMMARY OF THE INVENTION

The object of the present invention is to provide a telescopic emergency egress device which is operated easily and quickly.

Another object of the present invention is to provide a telescopic emergency egress device by which a user may move his body outside the building in an easy and relaxed manner.

Still another object of the present invention is to provide a telescopic emergency egress device which eliminates the necessary of occupying interior floor space for storage.

DETAILED DESCRIPTION OF PREFERRED EMBODIMENT

The figures show a preferred embodiment of a telescopic emergency egress device in accordance with the present invention.

Figure 1:
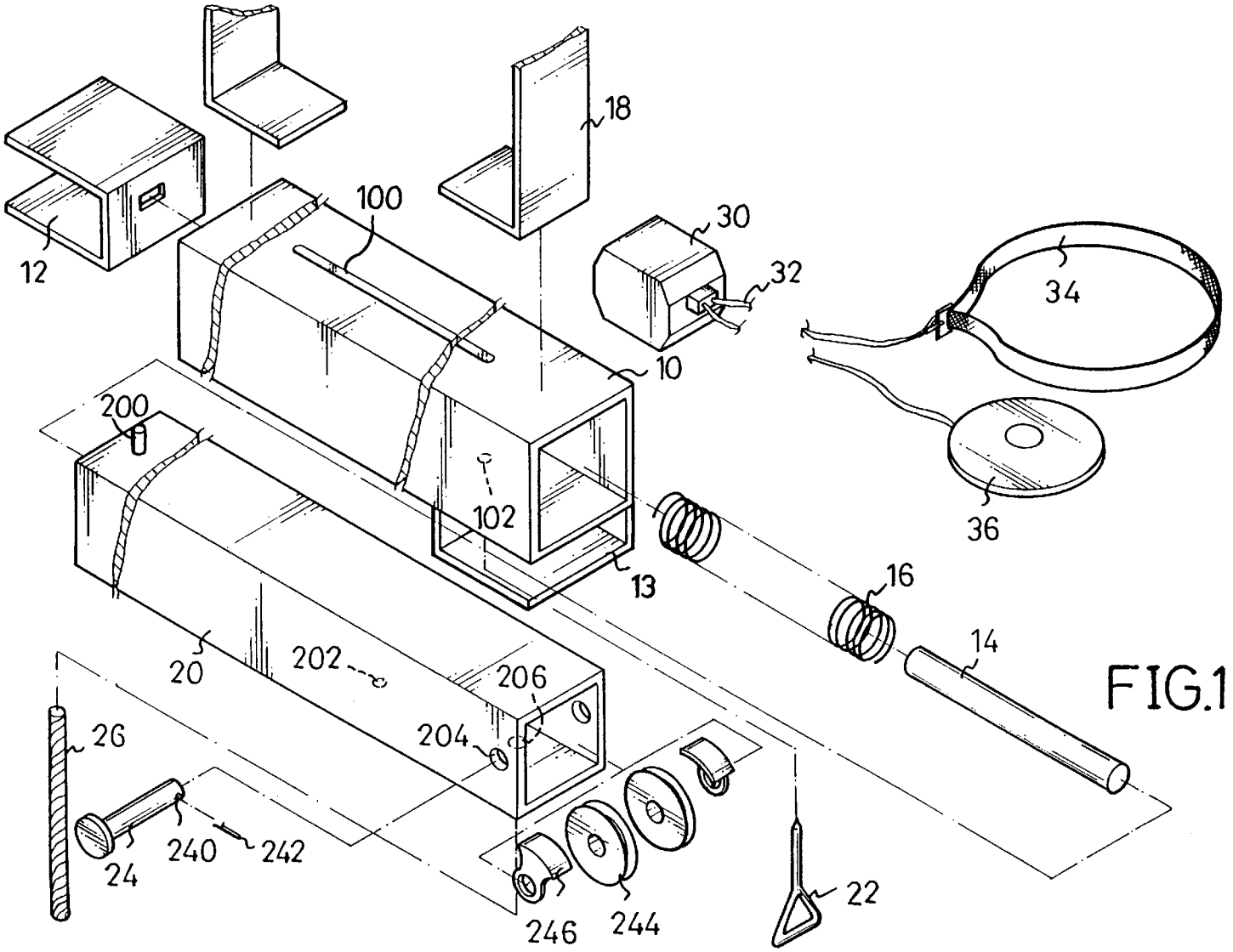
FIG. 1 is a schematic exploded view of a telescopic emergency egress device in accordance with the present invention.
Figure 2:
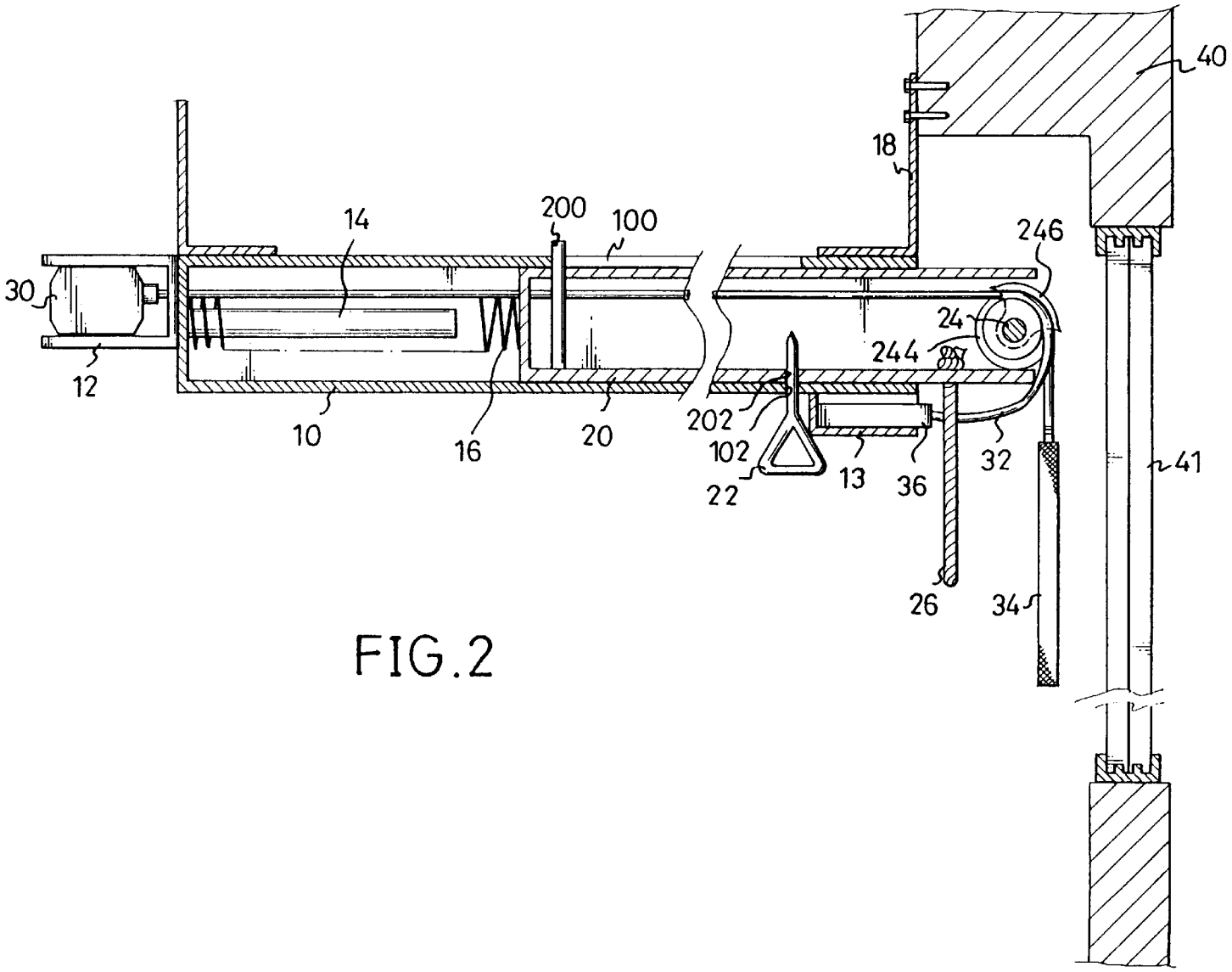
FIG. 2 is a schematic cross-sectional view showing the telescopic emergency egress device of FIG. 1 in assembly.
Figure 3:
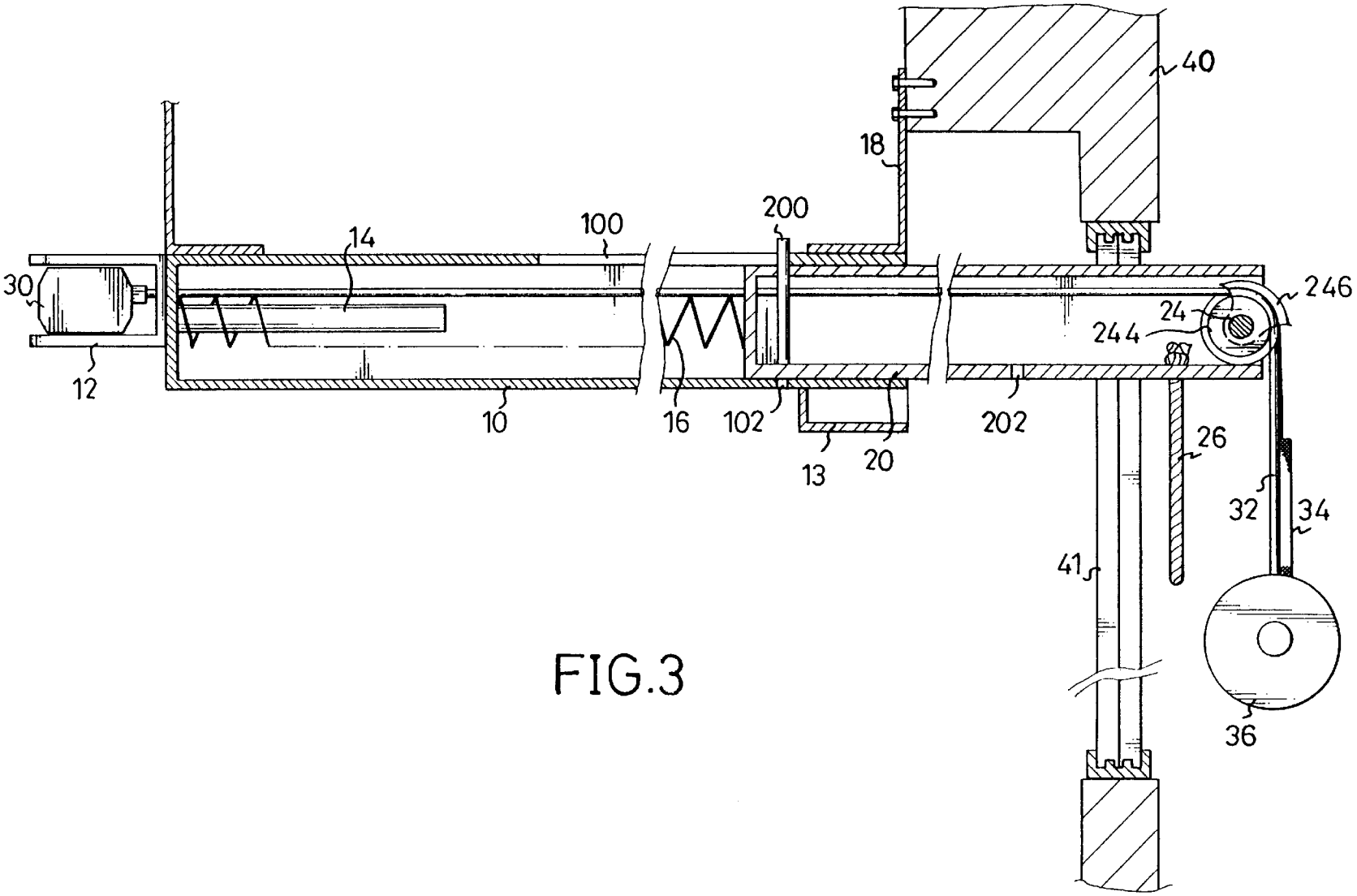
FIG. 3 is a schematic cross-sectional view showing the telescopic emergency egress device of FIG. 1 in use.
Figure 4:
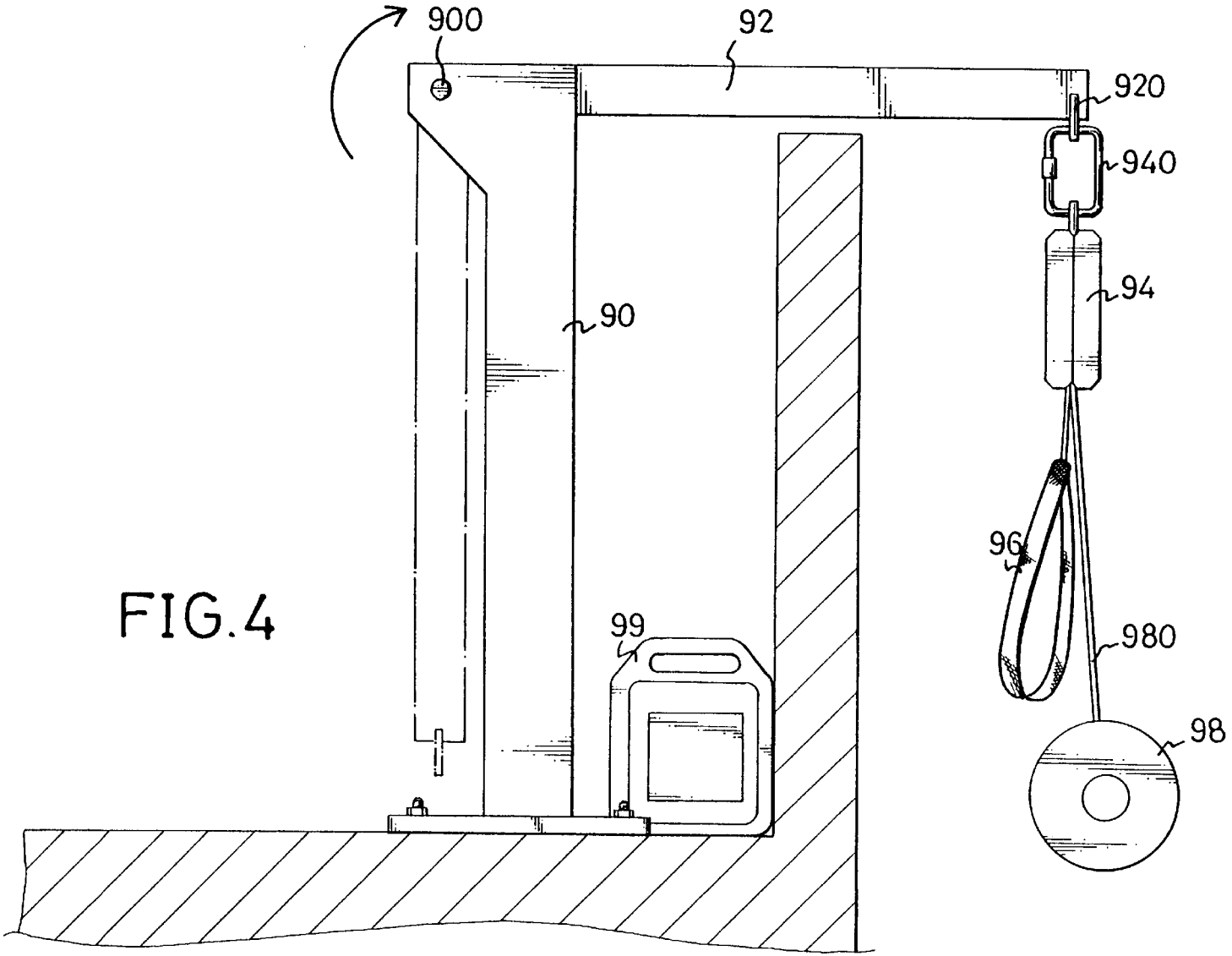
FIG. 4 is a schematic view of a conventional emergency egress device.

Referring to FIG. 1, the telescopic emergency egress device comprises an outer tube (10) having a front end and a back end. The outer tube (10) with a first hole (102) defined therein includes a longitudinal groove (100). A seat (12) is attached to the back end (i. e. the end facing towards the interior of the building) of the outer tube (10), and the front end of the outer tuber (10) is open with a receptacle (13) formed underneath. In the outer tube (10). there is a spring (16) in compression through which a guiding rod (14) extends to prevent the spring (16) from buckling. The outer tube (10) may be suspended from the ceiling or a beam in a room, by means of a pair of hangers (18), as shown in FIGS. 2 and 3.

An inner tube (20) having a front end is telescopically movable inside of the outer tube (10) between a retracted position and an extended position. The inner tube (20) includes a stud (200) that extends into and is movable along the longitudinal groove (100) of the outer tube 10 to limit the movement of the inner tube (20) to a range between the fully retracted position and the fully extended position, and a second hole (202) in alignment with the first hole (102) of the outer tube (10) when the inner tube (20) is in its fully retracted position.

A pair of opposite bores (204) are defined in the front end of the inner tube (20) to receive a pin (24) which rotatably mounts a pair of pulleys (244). The pin (24) has an orifice (240) defined at a distal end thereof for holding the pin (24) in the bores (20), by means such as a cotter pin (242), and more preferably a pair of baffles (246) are rotatably attached to the pin (24) and partially covers the pulleys (244). In a bottom of the inner tube (20) near the front end thereof, there is an aperture (206) through which a rope (26) is suspended from the inner tube (20). In addition, there is provided a retainer, such as a pintle (22), which extends through the holes 102 and 202 of the tubes 10 and 20 to retain the inner tube (20) in the retracted position.

Similar to the prior art described above, the inventive telescopic emergency egress device includes a governor (30) with a rope (32) reeved therethrough, which are adopted to lower a person from a higher level, such as a high building, to a lower level, such as the ground, at a speed of sufficient safety to him/her. s However, in the present invention the governor (30) is mounted in the seat (12), with the rope (32) reeved over one of the pulleys (244) and under its respective baffle (246), traveling backwardly within the tubes 10 and 20 to the governor (30) where the rope (32) reverses direction to travel forward, and is then reeved over the other pulley 244 and under its respective baffle (346). The rope (32) is also terminated in a harness (34) and a reel (36) at respective ends thereof.

FIG. 2 is a schematic cross-sectional view showing the application of the telescopic emergency egress device in an apartment or a room. In the case illustrated, the outer tube (10) is suspended from a beam (40) of the room by a hanger (18), with the front end of the inner tube (20) facing toward a window (41) immediately below the beam (40) and being in a retracted position, with the inner tube (20) extending slightly out and beyond the front end of the outer tube (10). At this time, the spring (16) is compressed between the ends of the tubes 10 and 20, thus exerting upon the inner tube (20) a force which tends to move the inner tube (20) much further out of the outer tube (10) to its extended position once the pintle (22) is pulled out of the holes 102 and 202 of the tubes 10 and 20. In accompany with this, the harness (34) is depend from the rope (32) and hangs just below the end of the inner tube (20). The reel (36) is stored in the receptacle (13) formed beneath the outer tube (10), with the retracting rope (26) hanging perpendicularly.

In other words, the telescopic emergency egress device is retained in the retracted position by the pintle (22), which locks the inner tube (20) in place against the force exerted by the spring (16) which is in compression.

Therefore, in the case of an emergency such as when the building is on fire, the inner tube (20) may be quickly moved from the retracted position, the one shown in FIG. 2, to the extended position, the one shown in FIG. 3, simply by pulling the pintle (22) out of the holes 102 and 202 immediately after the window (41) is opened. Both the harness (34) and the reel (36) will be displaced to the outside of the window (41) (or room) following the movement of the inner tube (20). As a result, the reel (36) falls down and unwinds a length of the rope (32), which was originally wound onto the reel (36). Then, after taking the harness (34) and wrapping it about his/her body, the user may climbs onto a windowsill or a rail on a balcony to free his/her body from the building to a suspension while grasping the rope (26), and looses his/her grip prior to lowering himself/herself at an appropriate speed, i.e. a speed controlled by the governor (30).

From the foregoing, it is clear that the telescopic emergency egress device of the present invention is beneficial in that it is operated easily as well as quickly, thereby allowing the user to escape from danger as soon as possibly. The user may also move his body outside the building with ease, since it is from a substantially equal level that he/she reaches a suspended position from which he/she starts to be lowered. Moreover, the suspension of the telescopic emergency egress device eliminates the necessity of storage area on the floor.

What is claimed is:

1. A telescopic emergency egress device, comprising:

an outer tube having a front end and a back end;

an inner tube having a front end and being telescopically movable inside of said outer tube;

a spring compressed to push said inner tube to move from a retracted position to an extended position;

a retainer operable to maintain said inner tube in said retracted position; and means for lowering a person at said front end of said inner tube from a higher level to a lower level at a speed of sufficient safety to the person, said means for lowering including a pair of pulleys pivotally mounted to said front end of said inner tube, a governor positioned behind said back end of said outer tube, a rope passing through said governor and reeved over said pair of pulleys, a harness attached to an end of said rope, a reel attached to the other end of said rope, and a receptacle underlying said front end of said outer tube to store said reel, wherein, said rope travels in a sequence of being reeved over one of said pair of pulleys, then running backward within said tubes to said governor through which said rope extends so as to reverse its direction to travel forward, and being reeved over the other end of said pair of pulleys.

2. The telescopic emergency egress device as claimed in claim 1, wherein said outer tube has a longitudinal groove defined therein and wherein said inner tube has a stud extending into and movable along said longitudinal groove of said outer tube, thereby limiting the movement of said inner tube to a range between said retracted position and said extended position.

3. The telescopic emergency egress device as claimed in claim 1, wherein said outer tube has a first hole radially defined in place thereof and said inner tube has a second hole in alignment with said first hole of said outer tube when said inner tube is in said retracted position, and wherein said retainer is formed into a pintle extending through said holes of said tubes.

4. The telescopic emergency egress device as claimed in claim 1, wherein said means for lowering further include a seat attached to said back end of said outer tube to mount said governor.

5. The telescopic emergency egress device as claimed in claim 1 further including a guiding rod extending through said spring, thereby preventing said spring in compression from buckling.

6. The telescopic emergency egress device as claimed in claim 1 further including hangers for suspending said outer tube from the ceiling or a beam in a room.

7. The telescopic emergency egress device as claimed in claim 1, wherein a pair of opposite bores are defined in said front end of said inner tube and wherein said means for lowering include a pin which extends through said bores and around which said pair of pulleys are pivotally mounted.

8. The telescopic emergency egress device as claimed in claim 7, wherein said pin has an orifice defined at a distal end thereof for ensuring said pin of said means for lowering to be positively retained in said bores.

9. The telescopic emergency egress device as claimed in claim 7, wherein said means for lowering further include a pair of baffles mounted around said pin and partially about said pair of pulleys to prevent said rope from sliding out of the annular recesses formed in the peripheries of said pulleys.

10. The telescopic emergency egress device as claimed in claim 1, wherein said inner tube has an aperture defined in the bottom of said inner tube near said front end thereof, and wherein a retracting rope is suspended from said inner tube through said aperture.

* * * * *